US005151708A

United States Patent [19]

Nakase et al.

[11] Patent Number: 5,151,708

[45] Date of Patent: Sep. 29, 1992

[54] SHORTENED MAST ANTENNA WITH COMPENSATING CIRCUITS

[75] Inventors: Kazuhiko Nakase, Tokyo; Moriyoshi Kawasaki, Kanagawa, both of Japan

[73] Assignee: Harada Kogyo Kabushiki Kaisha, Tokyo, Japan

[21] Appl. No.: 614,280

[22] Filed: Nov. 15, 1990

Related U.S. Application Data

[63] Continuation-in-part of Ser. No. 491,489, Mar. 9, 1990.

[30] Foreign Application Priority Data

Mar. 10, 1989 [JP] Japan ..... 1-58790
Nov. 15, 1989 [JP] Japan ..... 1-297183

[51] Int. Cl.[5] ..... H01Q 1/00

[52] U.S. Cl. ..... 343/722; 343/858; 455/293

[58] Field of Search ..... 343/702, 722, 860, 745, 343/715, 900, 901, 903, 858, 852; 455/290, 291, 293, 297

[56] References Cited

FOREIGN PATENT DOCUMENTS 2166898 8/1976 Fed. Rep. of Germany ..... 343/701
2558862 7/1977 Fed. Rep. of Germany ..... 343/701

*Primary Examiner*—Michael C. Wimer
*Assistant Examiner*—Hoanganh Le
*Attorney, Agent, or Firm*—Koda and Androlia

[57] ABSTRACT

An automobile mast antenna used in a state shorter than its resonant state including an FM compensating circuit made only of passive elements and compensating for FM signals and an AM compensating circuit made of active elements that convert high impedance into low impedance and compensating for AM signals. The FM compensating circuit is formed with a primary resonance circuit and a secondary resonance circuit, in which the primary resonance circuit resonates in FM band via impedance of an antenna mast and loading coil which is attached to the antenna mast, and the secondary resonance circuit resonates in FM band via a coil and capacitor. The primary and secondary resonance circuits are coupled by electrostatic capacitance of attachment section of the antenna mast so as to form a double-tuned circuit.

2 Claims, 4 Drawing Sheets

SHORTENED MAST ANTENNA WITH COMPENSATING CIRCUITS

DETAILED DESCRIPTION OF THE INVENTION

1. Field of the Invention

The present invention relates to an AM/FM receiving antenna which is mounted to an automobile, and more particularly, to a shortened mast antenna which is equipped with compensating circuits.

2. Prior Art

When a shortened mast antenna is used as an automobile antenna for AM/FM reception, the sensitivity shows a conspicuous drop. Conventionally, therefore, an AM broad-band amplifier and an FM broad-band amplifier are connected in parallel and then inserted between the antenna and feeder line.

Figure 6:
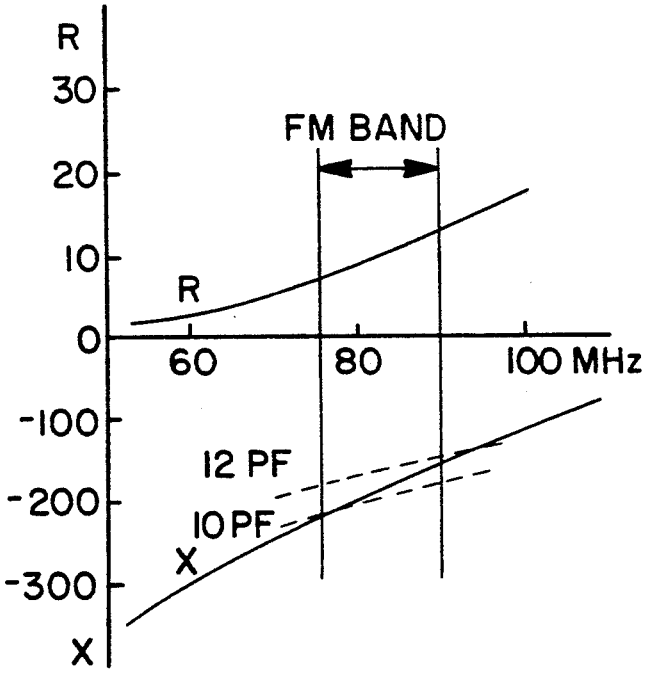
FIG. 6(1) PRIOR ART
Figure 6:
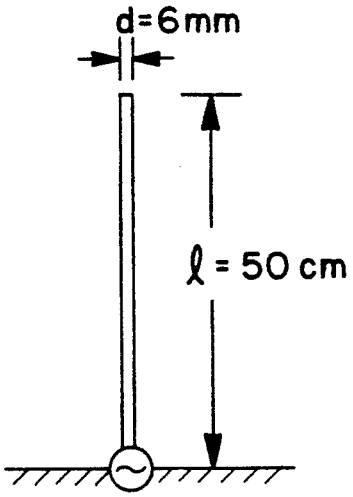
FIG. 6(2) PRIOR ART

Specifically, when an AM/FM receiving antenna is used in the FM frequency band and the antenna is set shorter than the resonant state of the antenna, e.g., if the antenna is used at a length (50 cm) which is approximately ½ the length at which the antenna resonates in the FM frequency band as shown in FIG. 6(2), the antenna resistance Ra becomes approximately 10 ohms as shown in FIG. 6(1). This is lower than the one in the resonant state (which is approximately 75 ohms), and the antenna reactance Xc is approximately −200 ohms (equivalent electrostatic capacitance: approximately 10 to 12 pF).

In addition, since automobile antennas are telescopic, the antenna can be stored inside the vehicle body when not in use. As a result, the stray capacitance (or floating capacitance) at the base portion of the antenna is generally set at 20 pF to 40 pF because of the mechanical structure of the antenna. As a result of this stray capacitance, the apparent antenna resistance becomes even lower.

If a commonly used coaxial type feeder line (with a characteristic impedance of 50 to 200 ohms) is directly connected to the antenna as described above, the matching loss becomes large. As a result, even if loading compensation is provided, the bandwidth is extremely narrow, and FM reception with good sensitivity becomes impossible. Conventionally, this problem has been solved by inserting broad-band amplifiers between the antenna and the feeder line as described above.

Meanwhile, if an AM/FM receiving antenna is used in the AM frequency band and the antenna length of the antenna is approximately 50 cm, the antenna length is extremely short compared to the wavelengths of the AM frequency band. As a result, the antenna resistance Ra becomes almost zero ohms, and the antenna reactance Xc becomes −20 to −50 kilo-ohms (of which equivalent electrostatic capacitance is approximately 7 pF), so that the antenna has an extremely high impedance.

When an antenna and a radio receiver are connected via a coaxial type feeder line, the length of the feeder line is short compared to the wavelengths involved. Accordingly, there is no need to give any consideration to impedance matching. However, there is a capacitance division loss due to the antenna capacitance and the stray capacitance of the antenna plus the electrostatic capacitance of the feeder line, resulting in a severe drop in reception sensitivity. Furthermore, in the case of motor-driven antennas, the length of the feeder line utilized therein is 4 to 5 meters, the electrostatic capacitance of such feeder line becomes 150 to 300 pF or greater, and the division loss in a 50 cm antenna becomes as much as −25 to −35 dB.

In some cases, a low-capacitance cable with a high characteristic impedance is used in order to reduce capacitance division loss. In such cases, however, the matching loss of FM signals is increased, and the FM reception sensitivity deteriorates. Conventionally, therefore, a compromise has been made by using a coaxial cable with a capacitance of 20 to 50 pF per meter.

PROBLEMS THE PRESENT INVENTION SOLVES

When powerful electromagnetic waves are received in conventional antennas of the type describe above, amplification is performed in non-linear ranges of the above-described broad-band amplifiers. As a result, amplitude distortion is generated, and the received audio signals are distorted.

Furthermore, when an attempt is made to receive other electromagnetic waves among powerful electromagnetic waves, cross modulation distortion and intermodulation distortion are generated by non-linear distortion of the broad-band amplifiers. As a result, not only are the audio signals received distorted, but reception sometimes also becomes impossible.

Moreover, the practical reception sensitivity drops as a result of the noise generated by the above-described broad-band amplifiers (i.e., the receiver input signal level required in order to obtain the prescribed S/N ratio, e.g., 20 dB in the case of the AM broadcast band or 30 dB in the case of the FM broadcast band, is increased).

Furthermore, since AM and FM broad-band amplifiers are used, the cost of the antenna equipped with such amplifiers is increased. If high-performance amplifiers with good linearity are used so as to prevent such distortions of the audio signals received, the cost is increased even further.

If the stray capacitance at the antenna attachment section can be 10 pF or less, matching loss can be reduced and reception sensitivity drop can also be prevented. However, in order to lower the stray capacitance of the antenna attachment section to 10 pF or less in motor-driven antenna, it is necessary to increase the antenna attachment section size-wise. However, this results in a new problem: i.e., the mechanical structure becomes complicated, which leads to an increase in manufacturing costs. This problem can be partially solved by eliminating the shielding for the antenna attachment section. In such a case, however, another problem occurs: i.e., depending on the conditions of attachment, the capacitance changes and the characteristics varies, thus increasing the susceptibility to external noise.

SUMMARY OF THE INVENTION

The object of the present invention is to provide a shortened mast antenna equipped with compensating circuits, which prevents audio distortion when powerful electromagnetic waves are received, which prevents faulty reception when other electromagnetic waves among powerful electromagnetic waves are received, which prevents any drop in a practical reception sensitivity, and which allows the size of the antenna mast attachment section to be reduced with simplified structure thereof.

In the present invention, an FM compensating circuit is formed by a primary resonance circuit and a secondary resonance circuit. The primary resonance circuit resonates in the FM frequency band by virtue of the impedance of the antenna mast and a loading coil which is attached to the antenna mast. The secondary resonance circuit resonates in the FM frequency band by virtue of a coil and a capacitor. In addition, the primary resonance circuit and secondary resonance circuit are electrostatically coupled via electrostatic capacitance of the antenna mast attachment section so that a double-tuned circuit is constructed.

In the present invention, a loading coil is installed in the antenna mast, and a tuning circuit is electrostatically coupled thereto via electrostatic capacitance of the antenna attachment section. Accordingly, there is no need for extreme reduction in the electrostatic capacitance of the antenna attachment section. As a result, the mechanical structure of the antenna attachment can be simplified, the matching loss can be reduced across a broad band, and the reception sensitivity drop can be alleviated. Furthermore, since the FM compensating circuit consists only of a passive element, the distortion of audio signals that occurs when powerful electromagnetic waves are received can be prevented, and faulty reception can be prevented when other electromagnetic waves are received among such powerful electromagnetic waves. Moreover, since the output impedance of the AM compensating circuit is lowered, the capacitance division loss of the antenna and the feeder line is reduced. As a result, the sensitivity drop can be prevented, and the overall cost of the antenna can be reduced.

EMBODIMENTS OF THE INVENTION

Figure 1:
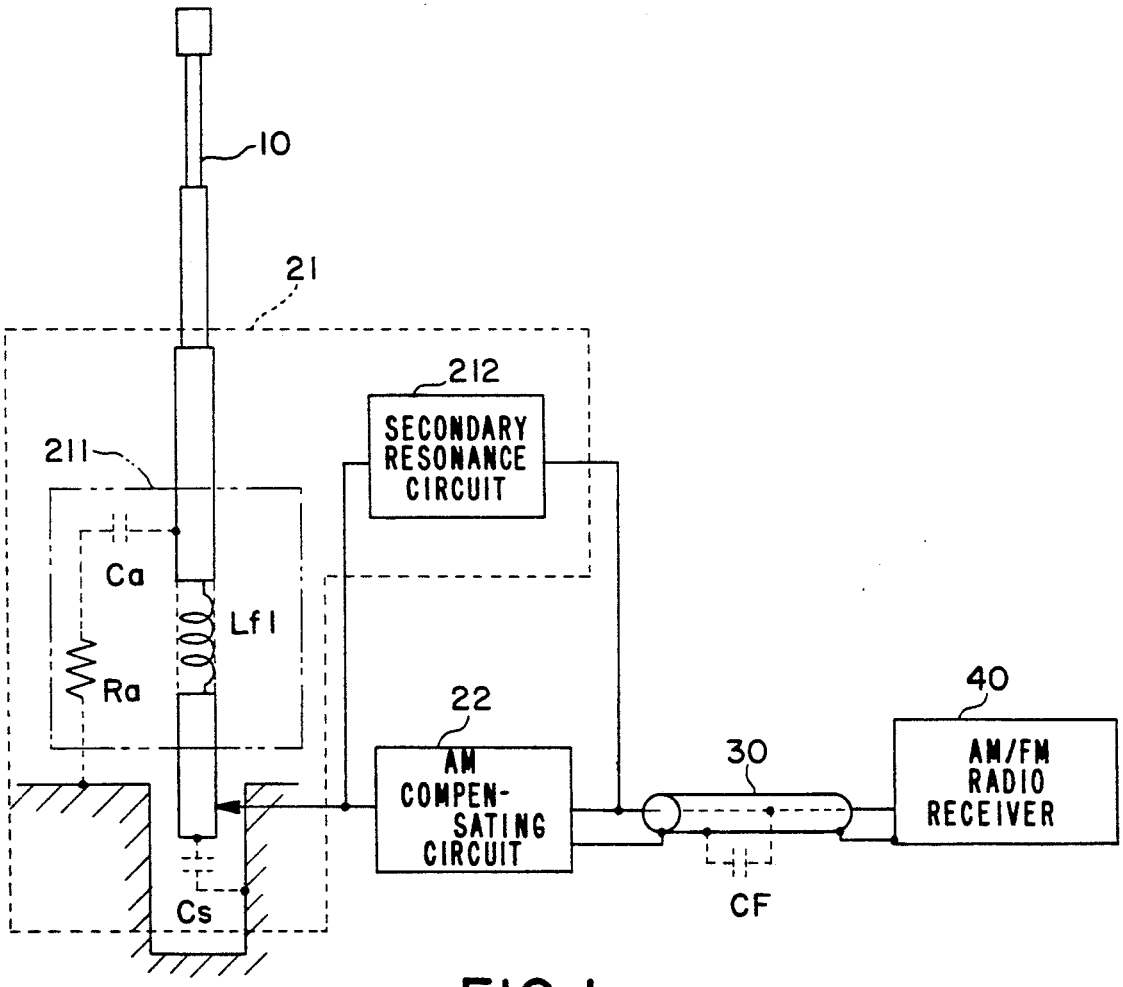
Figure 2:
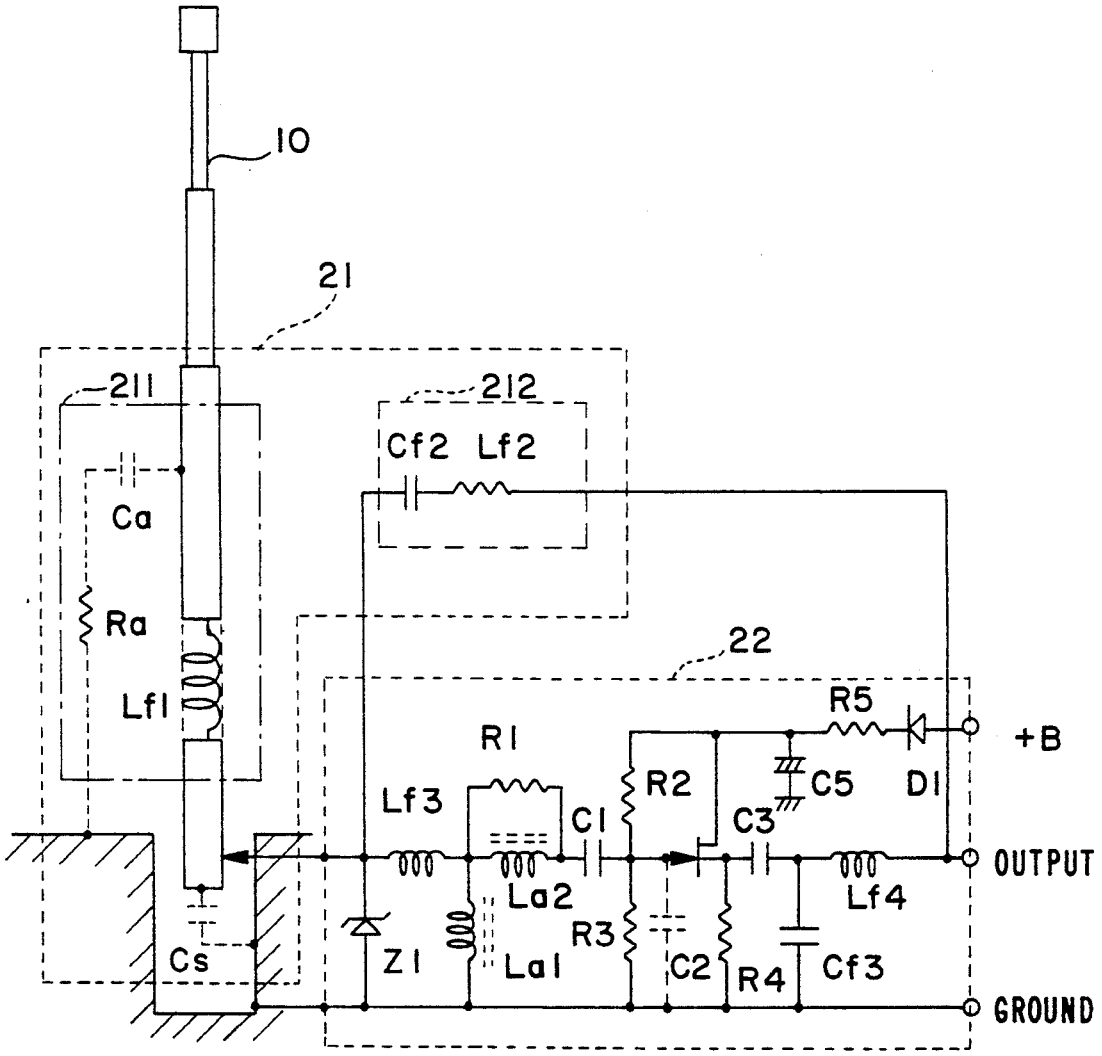

FIG. 1 is a circuit diagram illustrating one embodiment of the present invention. This circuit diagram shows a case wherein a 50 cm shortened mast is used. FIG. 2 is a circuit diagram of the radio receiver in this embodiment.

In this embodiment, an FM compensating circuit 21 and an AM compensating circuit 22 are directly connected to a telescopic antenna mast 10. The FM compensating circuit 21 includes only passive elements and compensates for FM broadcast signals. This circuit 21 is formed of a primary resonance circuit 211 and a secondary resonance circuit 212.

The primary resonance circuit 211 is a series resonance circuit which consists of the impedance of the antenna mast 10 (i.e., the resistance component Ra of the antenna 10 and the capacitance component Ca of the antenna 10) and a loading coil Lf1 which is attached to the antenna mast 10. This circuit 211 resonates in the FM frequency band.

The secondary resonance circuit 212 is a series resonance circuit which consists of a coil Lf2 and a capacitor Cf2, and this circuit 212 resonates in the FM frequency band. The primary resonance circuit 211 and the secondary resonance circuit 212 are electrostatically coupled by the electrostatic capacitance Cs of the attachment section of the antenna mast 10, so that a double-tuned circuit is constructed.

The AM compensating circuit 22 is made up with active elements that convert a high impedance into a low impedance, compensating for AM broadcast signals. Specifically, the AM compensating circuit 22 has an FET, and this FET is caused to act as a source follower, resulting in that AM broadcast signals are received at a high impedance and outputted as low-impedance signals (100 to 200 ohms).

The compensating circuits 21 and 22 are directly connected to the antenna mast 10 in order to reduce the stray capacitance Cs (including electrostatic capacitance of the antenna attachment section) which is on the antenna mast side.

The letter "a" appended to "L" that represents the coils and to "C" that represents the capacitors, respectively, inside the compensating circuits 21 and 22 means "AM". Similarly, an appended "f" indicates "FM".

Surge protector Z1 absorbs high-voltage static electricity induced in the antenna 10 and thus protects FET (described below). The diode D1 protects this FET in cases where a DC power supply is erroneously connected in reverse. Furthermore, choke coils Lf3 and Lf4 block FM broadcast waves and thus separate the AM compensating circuit 22 from the FM compensating circuit 21.

Furthermore, the AM compensating circuit 22 has an input-side band-pass filter. The low cut-off characteristics of this input-side band-pass filter are determined by the electrostatic capacitance Cs of the antenna attachment section and an inductance La1 which is parallel to this capacitance. Furthermore, the high cut-off characteristics of the input-side band-pass filter are determined by input capacitance C2 of the FET and an inductance La2.

Figure 3:
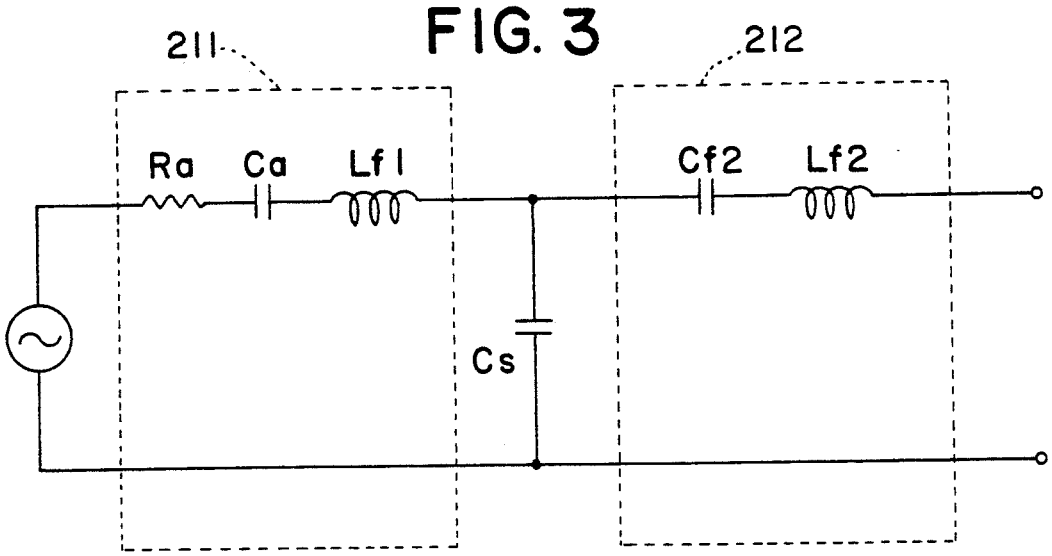

Next, the operation of the above-described embodiment will be explained:

The operation of the FM compensating circuit 21 will be first described:

FIG. 3 is the equivalent circuit diagram showing only the portions relating to FM characteristics.

In this embodiment, as shown in FIG. 2, the FM compensating circuit 21 (i.e., the circuit which matches the antenna mast 10 and the feeder line 30) consists only of passive elements. Accordingly, there is no susceptibility to distortion from powerful input signals. Furthermore, the cost is low compared to antennas in which active elements are used, and there is no need for power supply.

Furthermore, since the double-tuned circuit includes the electrostatic capacitance Cs at the attachment section of the antenna mast 10, good impedance matching can be achieved between the antenna mast 10 and the feeder line 30. Furthermore, broad-band coverage which covers the entire FM broadcast band is obtainable.

Moreover, since the loading coil Lf1 is installed in the antenna mast 10 and the tuning circuit is electrostatically coupled via the electrostatic capacitance Cs of the antenna attachment section, there is no need to extremely reduce the electrostatic capacitance Cs of the antenna attachment section. Accordingly, the mechanical structure of the antenna attachment section can be simplified.

Furthermore, since the antenna mast 10 is in a non-resonant state, it has a reactance component. Accordingly, by selecting the circuit constants so that the primary resonance circuit 211 of the double-tuned circuit resonates in the FM frequency band (including the loading coil Lf1 inserted in the antenna mast 10), it is possible to reduce the circuit loss and to simplify the circuit.

Moreover, a band required for receiving FM broadcast can be obtained by adequately selecting the coupling capacitance Cs.

Figure 5:
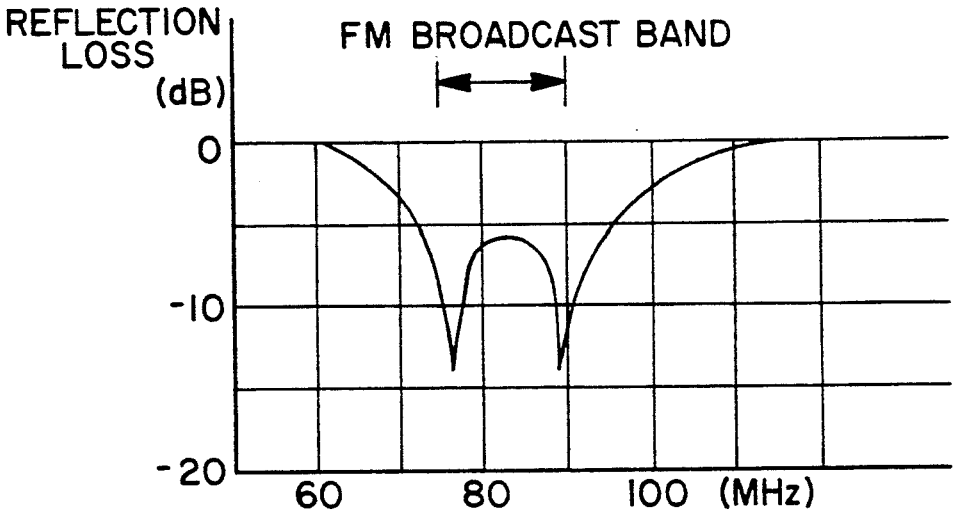

FIG. 5 shows reflection loss characteristics looking toward the antenna mast 10 from the output terminal of the above-described embodiment.

Figure 4:
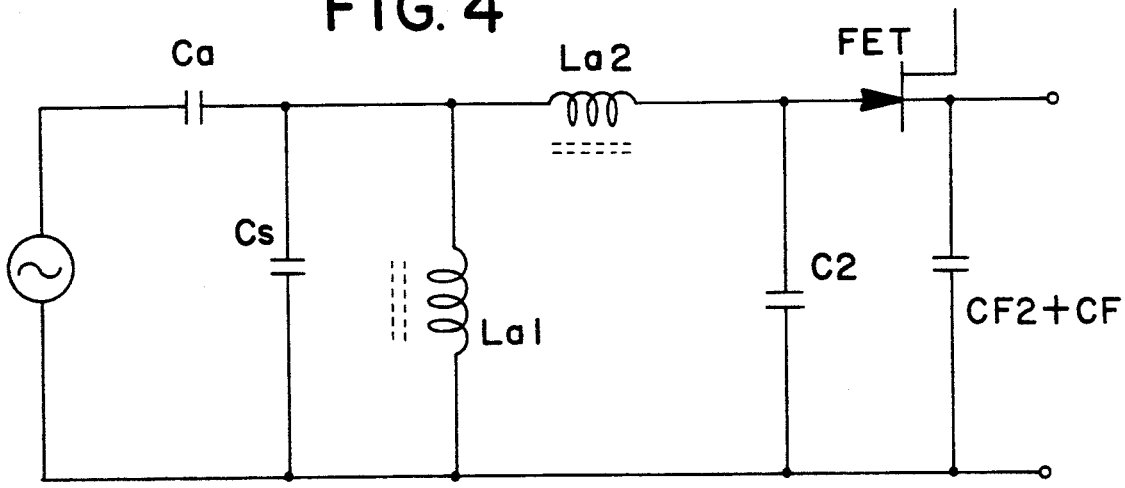

The operation of the AM compensating circuit 22 in the above embodiment will be described below:

FIG. 4 shows an equivalent circuit diagram showing only the portions relating to AM characteristics.

The FET within the AM compensating circuit 22 performs an active impedance conversion. Therefore, the output impedance of the AM compensating circuit 22 is lowered to a value of approximately 100 to 200 ohms, and the impedance is thus reduced so that capacitance division loss caused by the feeder line 30 can be virtually ignored. More specifically, since the output impedance of the AM compensating circuit 22 is low, a capacitance of 150 to 300 pF will have almost no effect even if such a capacitance is connected in parallel to the output of the FET. Accordingly, a coaxial cable of 50 to 70 ohms (which is optimal for FM transmission) can be used as the feeder line 30.

Furthermore, since the FET is caused to act as a source follower, the input/output characteristics can be caused to act linearly up to approximately ½ the DC power supply voltage. Accordingly, the circuit can be operated without any susceptibility to various types of non-linear distortion up to powerful input signals with a strength of approximately 130 dB-microns. Thus, no problems occur during an ordinary use.

Moreover, an emitter follower transistor can be used instead of the FET in the AM compensating circuit 22.

MERITS OF THE INVENTION

According to the present invention, in an automobile radio antenna which is used in a state shorter than the resonant state of the antennas, distortion of audio signals during the reception of powerful electromagnetic waves and faulty reception during the reception of other waves among powerful electromagnetic waves are prevented. Furthermore, the size of antenna attachment section of the antenna can be reduced, and the structure of such attachment section can be simplified.

We claim:

1. A shortened radio antenna provided with compensating circuits whose outputs are coupled to an input of an AM/FM radio receiver, said shortened radio antenna comprising a mast antenna shorter than a resonant state and being provided on an automobile, an FM compensating circuit coupled to said mast antenna comprising only passive circuit elements for compensating for FM broadcast signals and an AM compensating circuit coupled to said mast antenna comprising active and passive elements for converting a high impedance into a low impedance and for compensating for AM broadcast signals, wherein said FM compensating circuit comprises a primary resonance circuit and a secondary resonance circuit, said primary resonance circuit resonating in said FM broadcast frequency band and comprising an impedance of said mast antenna and a loading coil which is attached to said mast antenna, said secondary resonance circuit resonating in said FM broadcast frequency band and comprising a coil and a capacitor, and said primary and secondary resonance circuits are electrostatically coupled by an electrostatic capacitance of an antenna attachment section of said mast antenna so as to form a double-tuned circuit.

2. A shortened radio antenna according to claim 1 wherein said AM compensating circuit includes an input band-pass filter and said band-pass filter comprises a low frequency cut off portion comprising said electrostatic capacitance of said antenna attachment section and a first inductance in parallel with said electrostatic capacitance, and a high frequency cut off portion comprising an input capacitance of said active circuit elements and a second inductance in series with said input capacitance.

* * * * *